United States Patent [19]

Takahashi

[11] 4,359,697

[45] Nov. 16, 1982

[54] ULTRASONIC WAVE NEBULIZER DRIVING CIRCUIT

[75] Inventor: Minoru Takahashi, Funabashi, Japan

[73] Assignee: TDK Electronics, Co. Ltd., Tokyo, Japan

[21] Appl. No.: 294,845

[22] Filed: Aug. 21, 1981

Related U.S. Application Data

[63] Continuation of Ser. No. 56,614, Jul. 11, 1979, abandoned.

[30] Foreign Application Priority Data

Aug. 3, 1978 [JP] Japan ..... 53-106104

[51] Int. Cl.[3] ..... H01P 3/08

[52] U.S. Cl. ..... 331/116 R; 310/316; 331/1 R

[58] Field of Search ..... 331/1 R, 26, 116 R, 331/116 M, 155, 139, 109; 310/316, 116, 311

[56] References Cited

U.S. PATENT DOCUMENTS

| | | | |
|---|---|---|---|
| 3,681,626 | 8/1972 | Puskas | 310/316 |
| 3,866,068 | 2/1975 | Krenicki et al. | 310/316 |
| 4,177,434 | 12/1979 | Ida | 331/116 M |
| 4,275,363 | 6/1981 | Mishiro et al. | 331/116 R |
| 4,318,062 | 3/1982 | Mitsui et al. | 331/116 R |

*Primary Examiner*—David K. Moore

*Attorney, Agent, or Firm*—Robert Scobey

[57] ABSTRACT

Positive feedback is applied from the piezo-electric vibrator in an ultrasonic nebulizer to the control electrode in the oscillator circuit for improved performance.

9 Claims, 5 Drawing Figures

ULTRASONIC WAVE NEBULIZER DRIVING CIRCUIT

This is a continuation of application Ser. No. 056,614, filed July 11, 1979, now abandoned.

BACKGROUND AND BRIEF DESCRIPTION OF THE INVENTION

This invention relates to an ultrasonic nebulizer and more particularly to the oscillator circuit for driving the piezo-electric vibrator.

In an ultrasonic liquid nebulizer of conventional type, it is usual to drive the piezo-electric vibrator by a driving circuit constituted of a transistor oscillation circuit. Ultrasonic waves are generated to nebulize liquids, such as water, by the oscillation energy of the piezo-electric vibrator. Various conventional oscillator circuits have been employed. Generally, when the driving output is variable to regulate the nebulizing rate, the circuit is provided with a resistor connected in series with the bias resistor to vary the bias current for the transistor. However, a large base current of the transistor is often required with the bias resistor having a resistance of 1000 ohms to 3000 ohms and a capacity of approximately 2 watts, e.g., requiring a special variable resistor, thus making it difficult to regulate the driving output.

This invention eliminates such disadvantage. An ultrasonic nebulizer driving circuit according to the invention requires a reduced capacity for the bias resistor and facilitates regulation of the driving output by positive feedback, of a part of the high frequency energy at the piezo-electric vibrator, to the base of the transistor.

Explanation will be made hereinafter of an ultrasonic nebulizer driving circuit embodying the present invention referring to the attached drawings.

Figure 1:
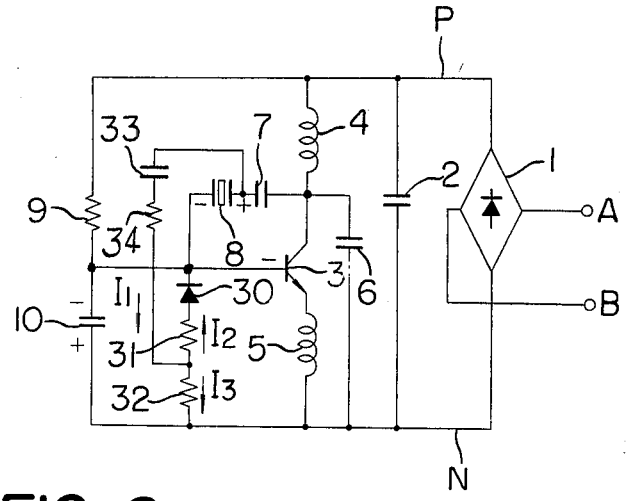
FIG. 1 is a circuit diagram of a first embodiment of the present invention.

In the drawings reference numerals designate: 1: a rectifier; 2, 6, 7, 10, and 33: condensers; 3: a transistor; 4 and 5: coils; 8: a piezo-oscillator; 9, 31, and 32: resistors; 20: a transformer and 30: a diode.

DETAILED DESCRIPTION

In a Colpitts oscillator of FIG. 1, an AC voltage applied to a power source terminals (A) and (B) is rectified by a rectifier (1), then smoothed by a smoothing condenser (2). A DC voltage thus produced is supplied to a positive line (P) and a negative line (N). The collector and the emitter of a transistor (3) are connected to the positive line (P) and the negative line (N) through a coil (4) and a coil (5), respectively. A condenser (6) constituting a parallel resonance circuit with the coil (4) is connected between the collector of the transistor (3) and the negative line (N). A piezo-electric vibrator (8) is connected between the collector and the base of the transistor (3) through a DC impedance condenser (7). A bias resistor (9) and a condenser (10) are respectively connected between the base of the transistor (3) and the positive line (P) and between the base and the negative line (N). The circuit components thus far described, constituting a conventional Colpitts oscillator, normally produce an oscillation output of several tens of watts. In accordance with the present invention, a series connection of a diode (30) and resistors (31) and (32) is connected between the base of the transistor (3) and the negative line (N), and a series connection of a condenser (33) and a resistor (34) is connected between the junction of the piezo-electric vibrator (8) and condenser (7) and the junction of resistors (31) and (32), thus constituting a positive feedback circuit. Representative values of the circuit elements are: the resistor (9): 6.8 to 15 K ohms ($\frac{1}{2}$ watt), the condenser (33): 150 to 220 pF, the resistor (34): 200 ohms ($\frac{1}{4}$ watts), the resistors (31) and (32): 500 ohms ($\frac{1}{4}$ watt). The constants (representative) of those other elements are: coil (4): 20 to 30 micro H, coil (5): 0.5 to 2 micro H, condenser (2): 0.1 to 10 micro F, condenser (6): 1500 to 2000 pF, condenser (7): 15,000 to 20,000 pF, condenser (10): 3000 to 5000 pF vibrator (8): 20$\phi$–1.65 MHz. The impedance condenser (7) may be omitted.

Figure 2:
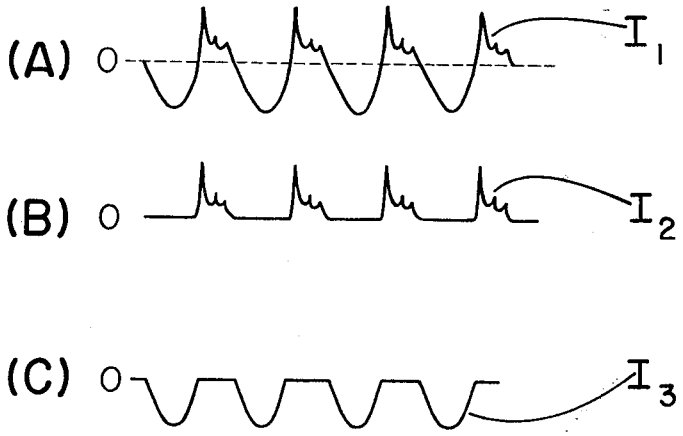
FIG. 2 constitutes current diagrams for explaining the operation of the circuit of FIG. 1.

In the circuit of FIG. 1, the base potential of the transistor (3) alternates between positive and negative, causing the condenser (10) to repeat charging and discharging. The high-frequency voltage produced at the terminals of the piezo-electric vibrator (8) causes current $I_1$ as illustrated in curve (A) of FIG. 2 to flow through the series circuit of the condenser (33) and the resistor (34). When the potential of the base of the transistor (3) is negative, as shown in FIG. 1, the electric charge of the condenser (10) is discharged through the resistors (31), (32), and the diode (30) flowing the discharge current from the negative line (N) to the base to drive the base to the negative side, thus biasing further the base to the negative side. At this moment, the direction of the high-frequency voltage produced at the terminals of the vibrator (8) is positive at the terminal connected to the condenser (33). Accordingly, the current $I_1$ is directed in the direction of the arrow to produce the current $I_2$ of curve (B) in FIG. 2, which is added to the discharge current of the condenser (10), further biasing the base of the transistor (3). Curve (C) in FIG. 2 illustrates the discharge current $I_3$ of the condenser (33) flowing through the resistor (32). On the other hand, when the base of the transistor (3) becomes positive, the diode (30) is inversely biased, and positive feedback is accordingly not applied.

In the circuit of FIG. 1, a part of the high-frequency energy applied to the piezo-electric vibrator (8) is fed back through the positive feedback circuit to drive the base potential further to the negative side only when the base of the transistor (3) is negative, and in this fashion the driving energy is increased. Accordingly, a lesser current is sufficient to supply the base of the transistor (3) through the bais resistor (9) because the positive feedback circuit supplements the current. Thus the resistance and the capacity of the bias resistor (9) may be reduced to 6.8 to 15 K ohms and approximately $\frac{1}{2}$ watts, respectively. Consequently, a common, inexpensive variable resistor may be connected in series with the bias resistor (9) to regulate the nebulizing rate by varying the driving output. Also, the driving output can be easily varied by making variable one of the resistors (31), (32), and (34).

Figure 3:
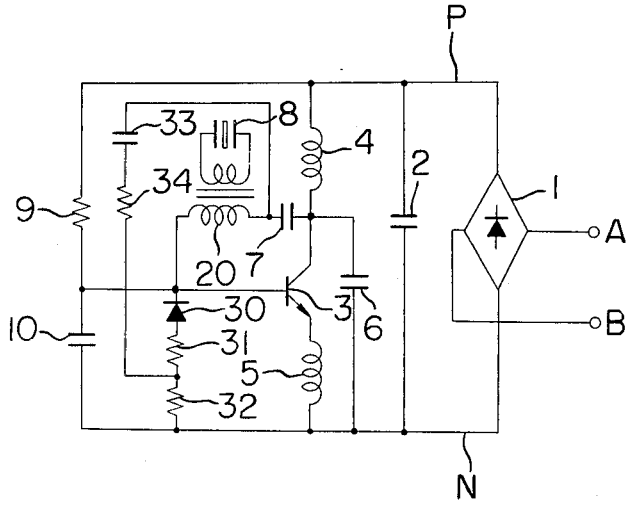
FIGS. 3 to 5 are circuit diagrams of other circuits embodying the present invention.

In the Colpitts oscillation circuit of FIG. 3, piezo-electric vibrator (8) is connected between the collector and the base of transistor (3) through a transformer (20). The rest of the circuit is similar to that of FIG. 1, and includes the positive feedback network of circuit elements 30–34. This circuit has the advantage that the efficiency of the oscillation circuit is improved and that plural driving units can be driven by a single power source as the vibrator (8) becomes DC floating because impedance matching is possible.

Figure 4:
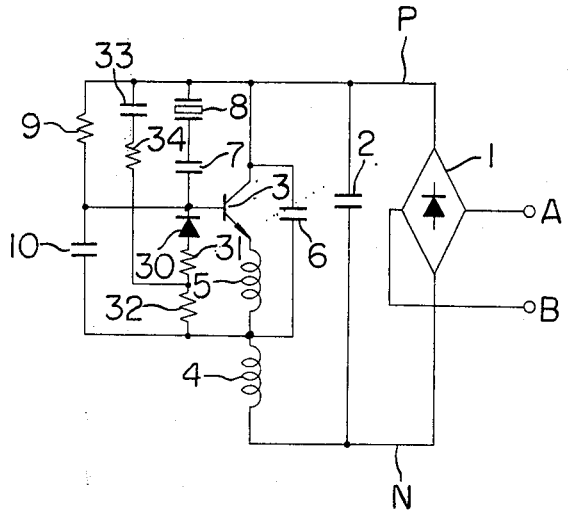

In the grounded collector type oscillation circuit of FIG. 4, AC voltage applied between power source terminals (A) and (B) is rectified by rectifier (1), then smoothed by smoothing condenser (2). A DC voltage thus produced is applied to the positive line (P) and the negative line (N). The collector of transistor (3) is directly connected to the positive line (P) and the emitter is connected to the negative line (N) through coils (4) and (5). Piezo-electric vibrator (8) is connected between the collector and the base of the transistor (3) through DC impedance condenser (7). Bias resistor (9) and condensers (6) and (10) are provided similarly to the circuit of FIG. 1. The impedance condenser (7) may be omitted. This circuit which includes the positive feedback network of circuit elements 30–34, allows the collector of the transistor (3) to be both DC and AC grounded, reducing the emission of noise from the circuit.

Figure 5:
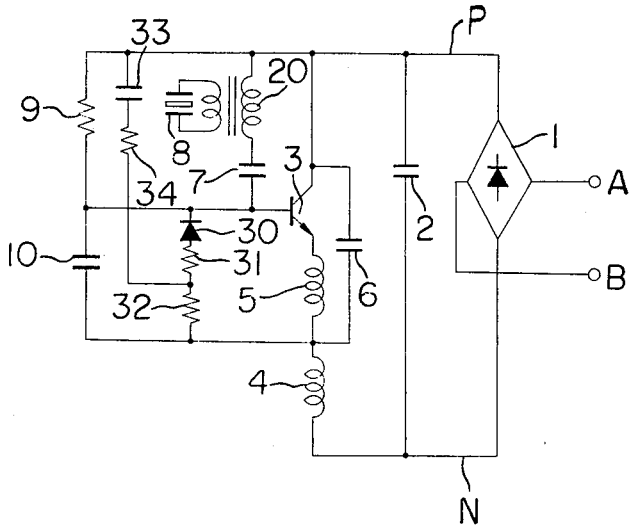

In the earthed collector type oscillation circuit of FIG. 5, piezo-electric vibrator (8) is connected between the collector and the base of transistor (3) through transformer (20). The rest of the circuit, which includes the positive feedback network of circuit elements 30–34, is similar to that of FIG. 4. In this circuit, condenser (33) of the positive feedback network is connected to the positive terminal of transformer (20).

In the circuits of FIGS. 4 and 5, the series connection of condenser (33) and resistor (34) may be alternatively connected between the junction of a resistors (31) and (32) and the negative line (N), since the positive line (P) and the negative line (N) are high-frequency-bypassed by the condenser (2).

As described hereinbefore, the present invention provides an ultrasonic nebulizer driving circuit capable of reducing the capacity of the bias resistor and facilitating the regulation of the driving output by positive feedback of a part of the high-frequency energy, produced at the terminals of the piezo-electric vibrator, to the base of the transistor.

It will be appreciated that the embodiments described above are subject to modification. The invention thus should be defined by the following claims.

What is claimed is:

1. In an ultrasonic nebulizer driving circuit that includes an oscillator for generating a high frequency signal to energize a piezo-electric vibrator that generates ultrasonic waves, said oscillator including a control element having a control electrode, means including a bias resistor for supplying a biasing current to said control electrode, the improvement comprising a positive feedback circuit to feed back a part of said high frequency signal to said control electrode independent of said bias resistor to supplement said biasing current and concomitantly enable said bias resistor to be reduced in wattage.

2. A circuit as in claim 1, wherein said feedback circuit comprises a capacitive pickup and resistive divider network coupled to said vibrator to develop a high frequency signal corresponding to the signal applied to said vibrator.

3. A circuit as in claim 2, including a diode element for coupling said capacitive pickup and resistive divider network to said control electrode.

4. A circuit as in claim 3, wherein said control element is a transistor.

5. A circuit as in claim 4, wherein said control electrode is the base of said transistor.

6. A circuit as in claim 5, wherein said diode is poled so as to increase in a negative sense the potential of said base.

7. A circuit as in claim 6, wherein said vibrator is coupled to the base and emitter of said transistor.

8. A circuit as in claim 7, wherein said vibrator is transformer coupled to said base and emitter.

9. A circuit as in claim 1, wherein said piezo-electric vibrator constitutes one of the oscillation elements of said oscillator.

* * * * *